US005306363A

United States Patent [19]

Masumoto et al.

[11] Patent Number: 5,306,363

[45] Date of Patent: Apr. 26, 1994

[54] THIN ALUMINUM-BASED ALLOY FOIL AND WIRE AND A PROCESS FOR PRODUCING SAME

[75] Inventors: Tsuyoshi Masumoto, 8-22, Kamisugi 3-chome, Aoba-ku, Sendai-shi, Miyagi-ken; Akihisa Inoue, Miyagi; Hitoshi Yamaguchi, Nagano; Noriaki Matsumoto, Tokyo; Kazuhiko Kita, Miyagi, all of Japan

[73] Assignees: Tsuyoshi Masumoto, Miyagi; Teikoku Piston Ring Co., Ltd., Tokyo; Honda Giken Kogyo Kabushiki Kaisha, Tokyo; Kogyo K.K. Yoshida, Tokyo, all of Japan; a part interest

[21] Appl. No.: 574,654

[22] Filed: Aug. 20, 1990

[30] Foreign Application Priority Data

Aug. 31, 1989 [JP] Japan ..... 1-223079

[51] Int. Cl.[5] ..... C22C 45/08

[52] U.S. Cl. ..... 148/561; 148/403

[58] Field of Search ..... 148/115 A, 403, 561; 420/528, 550, 552, 902

[56] References Cited

U.S. PATENT DOCUMENTS

| | | | |
|---|---|---|---|
| 4,950,452 | 8/1990 | Masumoto et al. | 420/550 |
| 5,053,084 | 10/1991 | Masumoto et al. | 420/902 |

FOREIGN PATENT DOCUMENTS

| | | | |
|---|---|---|---|
| 0303100 | 2/1989 | European Pat. Off. . | |
| 0317710 | 5/1989 | European Pat. Off. . | |
| 333216 | 9/1989 | European Pat. Off. . | |
| 339676 | 11/1989 | European Pat. Off. . | |
| 57-54222 | 3/1982 | Japan | 148/403 |
| 63-153237 | 6/1988 | Japan . | |

OTHER PUBLICATIONS

Chemical Abstract, vol. 71, 1969, p. 232 (No. 6117f).

*Primary Examiner*—George Wyszomierski

*Attorney, Agent, or Firm*—Lyon & Lyon

[57] ABSTRACT

An aluminum-based alloy foil or thin aluminum-based alloy wire is produced from an amorphous material made by a quenching and solidifying process and having a composition represented by the general formula:

$$Al_aM_bX_c$$

wherein M is one or more elements selected from a group consisting of V, Cr, Mn, Fe, Co, Ni, Cu, Zr, Ti, Mo, W, Ca, Li, Mg and Si; X is one or more elements selected from a group consisting of Y, Nb, Hf, Ta, La, Ce, Sm, Nd and Mm (misch metal); and a, b, and c are atomic percentages falling within the following range:

$$50 \leqq a \leqq 95$$

$$0.5 \leqq b \leqq 35 \text{ and}$$

$$0.5 \leqq c \leqq 25$$

Such foil or wire has a smooth surface and a very small and uniform foil thickness or wire diameter, contains at least 50% by volume of an amorphous phase, and has excellent strength and resistance to corrosion. The foil thickness and wire diameter are reduced in a rolling or drawing process at an elevated temperature over a short time period.

22 Claims, 1 Drawing Sheet

THIN ALUMINUM-BASED ALLOY FOIL AND WIRE AND A PROCESS FOR PRODUCING SAME

BACKGROUND OF THE INVENTION

1. Field of the Invention

The field of the present invention is thin aluminum-based alloy foils and wires which are excellent in strength and corrosion resistance, have a smooth surface, and have a very small thickness or diameter with a uniform distribution of thickness or diameter thereof, and a process for producing same.

2. Description of the Prior Art

The present inventors have already developed alloys within a wider range of compositions based on aluminum and have filed patent applications therefore, such as Japanese Patent Applications Laid-Open Nos. 47831/89; 127641/89; 240632/89; 240631/89; and 275732/89.

Such alloys are being studied for application to wider fields of structural members for vehicles, corrosion-resistant materials for chemical apparatus, corrosion- or wear-resistant coating materials and the like as materials exhibiting excellent specific strength (strength/alloy density), corrosion resistance and stability in high temperature, and workability.

Conventional amorphous alloys have been produced in the form of a ribbon, a wire, a powder or a coating film by a liquid quenching process, a submerged spinning process, a gas-atomizing process, or a physical or chemical vapor deposition process. In such cases, however, it is difficult to produce an amorphous ribbon of a thickness of 10 μm or less and an amorphous wire of a diameter of 50 μm or less. In addition, the materials such as the amorphous ribbon, wire or the like are non-uniform in thickness or diameter and also have a greater surface roughness. For this reason, such materials cannot be directly utilized in fields of applications in which an extremely small thickness, an extremely small fineness, a smoothness in surface and a uniformity in thickness and in diameter are required. Moreover, such materials are higher in hardness and strength, and currently it is impossible to easily effect the usual working processes such as rolling or drawing of such materials which otherwise might be effective for overcoming the above disadvantages.

SUMMARY OF THE INVENTION

It is an object of the present invention to provide an aluminum-based alloy foil or a thin aluminum-based alloy wire having a smooth surface and a uniform thickness or diameter while substantially maintaining the desirable properties, such as strength, possessed by an amorphous alloy ribbon or wire.

To achieve the above object, according to the present invention, there is provided an aluminum-based alloy foil or a thin aluminum-based alloy wire having excellent strength and resistance to corrosion, which is produced from a material made by a quenching and solidifying process and having a composition represented by the general formula:

$$Al_aM_bX_c$$

wherein M is one or more elements selected from the group consisting of V, Cr, Mn, Fe, Co, Ni, Cu, Zr, Ti, Mo, W, Ca, Li, Mg and Si; X is one or more elements selected from the group consisting of Y, Nb, Hf, Ta, La, Ce, Sm, Nd and Mm (misch metal); each of a, b and c are an atomic percentage, with the proviso that $$50 \leqq a \leqq 95$$

$$0.5 \leqq b \leqq 35 \text{ and}$$

$$0.5 \leqq c \leqq 25,$$

and which has a smooth surface and a very small and uniform thickness or diameter and contains at least 50% by volume of an amorphous phase. In addition, there is also provided a process for producing an aluminum-based alloy foil or a thin aluminum-based alloy wire of the type described above, comprising rolling or drawing an amorphous material having a composition represented by the above general formula at a temperature within a glass transition region, supercooled liquid region or ±100° K. of the crystallization starting temperature that is peculiar to the amorphous material.

The aluminum-based alloy foil according to the present invention is an alloy foil which is very thin and has a beautiful surface and a uniform thickness, as well as excellent strength, hardness and resistance to corrosion, and thus, it is useful as a laminate material requiring a corrosion-resistant property such as in food and chemical fields, or as a magnetic recording metal tape substrate, or as a brazing material for precision machinery. In addition, the thin aluminum-based alloy wire according to the present invention is an extremely thin alloy wire having excellent strength and resistance to corrosion and thus, it is useful as a filler for composite materials such as concretes, metals and resins.

Further, with the process according to the present invention, it is possible to efficiently produce an aluminum-based alloy foil or a thin aluminum-based alloy wire having excellent properties described above.

The above and other objects, features and advantages of the invention will become apparent from a reading of the following description of the preferred embodiment taken in conjunction with the accompanying drawings.

DESCRIPTION OF THE PREFERRED EMBODIMENTS

Figure 1:
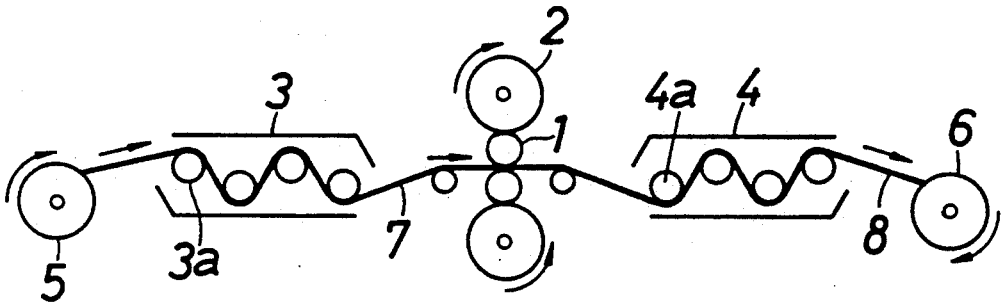
FIG. 1 is a diagram illustrating a rolling machine for producing an amorphous alloy foil and FIG. 2 is a diagram illustrating a drawing machine for producing a thin amorphous alloy wire.

Using various aluminum alloys representative of Al—Ni—Y based alloys, for example, as described in Japanese Patent Application Laid-Open No. 47831/89, amorphous alloy ribbons having a width of 1 to 300 mm and a thickness of 5 to 500 μm or amorphous alloy wires having a diameter of 0.01 to 1 mm can be produced by the utilization of a quenching and solidifying process. However, it is difficult to produce a high quality alloy foil or fine wire having a thickness of 10 μm or less, respectively or a diameter of 50 μm or less by such process. If such a member is intended to be produced, the resulting product may be of a partially non-uniform thickness or diameter and sometimes may have defects such as pores produced therein. Therefore, it is difficult to stably and continuously produce a high quality ribbon or wire. In order to stably and continuously produce a high quality ribbon or wire, the thickness of the ribbon has been limited to a range of 15 to 100 μm, while the diameter of the wire has been limited to a range of 80 to 150 μm.

The amorphous alloys show various glass transition temperatures Tg and crystallization temperatures Tx in an alloy composition within a range represented by the above-described general formula. In a region of temperatures between Tx—Tg, the alloys have the characteristic of a supercooled liquid while it is of a solid phase, and easily exhibit large plastic deformations under a very low stress. Some of such large plastic deformations reach 500% by applying simple tension (by loading of a uniaxial stress). Near to the crystallization temperature (Tx±100° K.), the alloys generate a super plasticity phenomenon and likewise exhibit large plastic deformations under a very low stress.

By paying attention to these characteristics and by selecting a rolling or drawing temperature within the glass transition region, or supercooled liquid region, or near to the crystallization temperature, a rolling or drawing can be easily conducted to provide an aluminum-based alloy foil or a fine aluminum-based alloy wire including at least 50% by volume of an amorphous phase and having a foil thickness of 10 μm or less or a wire diameter of 50 μm or less.

Here, the term "crystallization temperature Tx" means a starting temperature (°K.) of an exothermic peak initially appearing in a differential scanning calorimetric profile provided by heating an amorphous material under ambient pressure at a heating rate of 40° K./min, and the term "glass transition temperature Tg" indicates a starting temperature (°K.) of an endothermic peak initially appearing near a point below the crystallization temperature Tx.

It is commonly known that an amorphous alloy exhibits a large plastic deformation even at ambient temperature under a multi-axial stress, but the advantages of the process according to the present invention are in that working can be effected under a lower than normal stress and a higher rolling reduction (rate of reduction in section) of 50% or more and further that even a relatively brittle material that is difficult to roll or draw at ambient temperature can be easily worked. That is, it is possible to easily produce a continuous foil or a thin wire having a foil thickness of 10 μm or less or a wire diameter of 50 μm or less by the process of rolling or drawing, at one or two stages, a ribbon of a thickness of about 15 to 100 μm or a wire of a diameter of about 80 to 150 μm, which ribbon or wire is of an alloy composition within the above-described range and produced by a usual liquid quenching process.

The foils or thin wires produced by such process not only have a smooth surface and a uniform thickness or diameter, but also maintain the amorphous property of the amorphous ribbon or the like and exhibit excellent strength and resistance to corrosion. Some of such foils or thin wires may exhibit an increase in strength of 10 to 20% and an increase in ductility of 5 to 20% depending upon the alloy composition.

The stage of crystallization of an amorphous material proceeds with a balance of the temperature of the material and the time of retention thereof. If the temperature of the material is lower than the crystallization temperature Tx, the material is crystallized in a shorter time at a temperature nearer to the crystallization temperature Tx. If the temperature of the material is higher than the crystallization temperature Tx, the material is crystallized at a shorter time at a temperature farther from the crystallization temperature Tx.

In order to produce an alloy foil or thin alloy wire including at least 50% by volume of an amorphous phase by rolling or drawing an amorphous ribbon or wire having the above-described alloy composition according to the present invention, it is desirable that the working temperature is determined in a range approximately equal to the crystallization temperature Tx±100° K., preferably the crystallization temperature Tx±30° K., more preferably the crystallization temperature Tx−30° K., and that the working including all the heating, working and cooling steps is completed within 150 sec.

With amorphous materials having a composition as represented by the above-described general formula, however, most of them show a wider over-cooled liquid region Tx—Tg and within this region, the time of crystallization is largely delayed and hence wider acceptable ranges of working temperature and time can be employed.

More specifically, the aluminum alloy-based amorphous material having the alloy composition according to the present invention has a supercooled liquid region Tx—Tg in a range of 10° to 20° K., and, therefore, an alloy foil or a thin alloy wire including at least 50% by volume of an amorphous phase can be produced from this amorphous material even by setting the rolling or drawing temperature in this temperature region and using a working time within 600 sec. The working time is not independent and is determined depending upon the working temperature used and hence, the working time can be more prolonged by employing a lower working temperature.

As described above, in order to produce an alloy foil or a thin alloy wire comprising an amorphous phase, it is desirable that the entire working process including heating, working and cooling steps is completed within a time of 150 sec to 600 sec, depending on the material. For this purpose, it is essential to heat the material to the working temperature in a short time immediately before rolling or drawing and to cool the material immediately after working to a temperature (Tx−200° K. or less is preferred) at which the amorphous phase will not be phase-converted to a crystalline phase.

The actual working is conducted by a procedure which will be described below with reference to the drawings.

In producing an amorphous alloy foil, as shown in FIG. 1, a heating device 3 is disposed immediately upstream of work rolls 1 of a rolling machine and includes a plurality of heating rolls 3*a*. The heating rolls 3*a* are heated by an electrothermic source or any other conventional heat source and their temperature is controllable. In addition, a cooling device 4 is disposed immediately downstream of the work rolls 1 and includes a plurality of cooling rolls 4*a* which are cooled by water or another cooling medium. Thus, an amorphous ribbon 7 supplied from an unwinder 5 is heated to a predetermined working temperature through the heating device 3 while being continuously brought into contact with the individual heating rolls 3*a* and then, the heated ribbon is immediately rolled to a predetermined thickness by the work rolls 1. Subsequently, the amorphous alloy foil 8 produced by the rolling is immediately cooled to a predetermined temperature through the cooling device 4 while being continuously brought into contact with the individual cooling rolls 4*a* and is then taken up by a winder 6. The work rolls 1 are each supported by a back-up roll 2.

Figure 2:
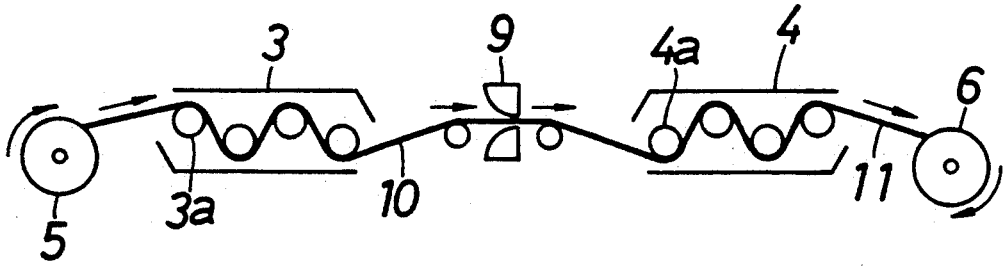

FIG. 2 illustrates a drawing machine for producing a fine amorphous alloy wire, wherein reference numeral 9 identifies a drawing die; reference numeral 10 identifies an amorphous wire; and reference numeral 11 identifies a fine amorphous alloy wire. The other components are the same as in FIG. 1 and hence, are designated by the same reference characters and the description thereof is omitted. In this case, a heating means also can be included in the drawing die 9.

The pluralities of heating and cooling rolls 3a and 4a within the heating and cooling devices 3 and 4 are rotated synchronously with a travel speed of the amorphous ribbon 7, amorphous wire 10, or the like.

By using the heating rolls 3a and the cooling rolls 4a as described above, the amorphous ribbon 7, amorphous wire 10, or the like can be rapidly heated and the amorphous alloy foil 8, fine amorphous wire 11, or the like can be rapidly cooled. It is also possible to use various other means for heating, such as by radiation from an electric heater or a heating box through which a high temperature gas convects, or a means for heating by contact of a high speed and high temperature gas with the amorphous ribbon 7, amorphous wire 10, or the like. Various other means for cooling may be used, such as, by contact with water or a high speed and low temperature gas by the fine amorphous alloy foil 8, amorphous wire 11, or the like. When the working speed is reduced, the amorphous ribbon 7 may be heated concurrently with rolling by including a heating device in the work roll 1 without provision of the heating device 3.

For purposes of further description without limiting the scope of the invention, specific examples of the product and process of this invention will now be described in further detail. Amorphous alloy foils 8 were produced using the rolling machine shown in FIG. 1. The starting materials prepared were five types of amorphous ribbons 7 coiled and having alloy compositions given in Table I with a thickness of 20 μm and a width of about 20 mm.

The heating device 3 was disposed at a place 30 cm upstream of the work rolls 1, and the cooling device 4 was disposed at a place 30 cm downstream of the work rolls 1. The heating device 3 included four heating rolls 3a of a diameter of 60 mm, each of which was controlled in temperature by an electric heating, while the cooling device 4 included four cooling rolls 4a of a diameter of 60 mm, each of which was cooled by water.

The work rolls 1 used were of a diameter of 20 mm, and heating of each work roll 1 was provided by conduction from the back-up roll 2. In this case, the heating temperature of the back-up roll 2 was set at near the desired working temperature for each amorphous ribbon 7.

The rolling temperature was set within ±5° K. of a temperature within the range of the crystallization temperature Tx of each ribbon 7 minus 30° K., or at a temperature within ±5° K. of a temperature equal to the temperature at the central portion of the supercooled liquid region of each ribbon 7. The rolling rate was set at 20 m/min, and the rearward tension on the amorphous ribbon 7 was set at 20 kg.

The following steps were continuously conducted, as generally described above, the step of providing an amorphous ribbon 7 around the unwinder 5, the step of passing the amorphous ribbon 7 as it is unwound from the unwinder 5 through the heating device 3 to heat it to the working temperature, the step of subjecting the amorphous ribbon 7 to the rolling to produce an amorphous alloy foil 8, the step of passing the amorphous alloy foil 8 through the cooling device 4 to cool it to approximately room temperature, and the step of taking up the amorphous alloy foil 8 around the winder 6.

Each amorphous alloy foil 8 thus produced was of a thickness of about 7 μm and a width of about 20 mm and had a beautiful surface and a uniform thickness with inaccuracies of ±0.1 μm or less both across the width and along the length of the foil 8.

Each foil 8 was examined for its structure by an X-ray diffraction and measured for tensile strength to provide the results given in Table I. In Table I, Amo means that the amorphous phase is of 100%; St. means Structure; Thi. means Thickness; Wid. means Width; and Stre. means Strength.

As apparent from Table I, it was ascertained that all the foils 8 were of an amorphous phase and had extremely excellent mechanical properties with a tensile strength of 1050 MPa or more.

TABLE I

| Alloy composition (atomic % in the subscripts) | Ribbon Tg (°K.) | Ribbon Tx (°K.) | Foil St. | Foil Thi. (μm) | Foil Wid. (mm) | Foil Stre. (Mpa) |
|---|---|---|---|---|---|---|
| $Al_{80}Fe_{10}Nb_{10}$ | — | 753 | Amo | 6.5 | 20 | 1050 |
| $Al_{80}Co_{10}Nb_{10}$ | — | 697 | Amo | 7.2 | 20 | 1125 |
| $Al_{85}Ni_5Y_{10}$ | 535 | 560 | Amo | 7.0 | 20 | 1210 |
| $Al_{85}Cu_{10}Mm_5$ | 538 | 552 | Amo | 6.8 | 20 | 1120 |
| $Al_{80}Ni_5Fe_5Ce_{10}$ | 615 | 633 | Amo | 7.0 | 20 | 1050 |

As further, examples of the product and process of this invention, thin amorphous alloy wires 11 were produced using a drawing machine as shown in FIG. 2.

Starting materials prepared were coils of four types of amorphous wires 10 of a diameter of 100 μm and having the alloy compositions given in Table II.

The heating device 3 was disposed at a place 30 cm immediately upstream of the drawing dies 9, and the cooling device 4 was disposed at a place 30 cm immediately downstream of the drawing dies 9. The heating device 3 included four heating rolls 3a of a diameter of 60 mm, each of which was controlled in temperature by an electric heater, while the cooling device 4 included four cooling rolls 4a of a diameter 60 mm, each of which was cooled by water.

The drawing dies 9 were heated by an electric heater. The heating temperature of the drawing dies 9 was set at near the desired working temperature of each amorphous wire 10.

The drawing temperature was set at a level within ±5° K. of a temperature within the range of the crystallization temperature Tx of each amorphous wire 10 minus 30° K., or at a level within ±5° K. of the temperature at the central portion of a supercooled liquid region of each amorphous wire 10. The drawing rate was set at 5 m/min.

The following steps were continuously conducted, as generally described above: the step of providing the amorphous wire 10 around the unwinder 5, the step of passing the amorphous wire 10 as it is unwound from the unwinder 5 through the heating device 3 to heat it to the drawing temperature, the step of subjecting the amorphous wire 10 to the drawing to fabricate a thin amorphous alloy wire 11, the step of passing the thin amorphous alloy wire 11 through the cooling device 4 to cool it to approximately room temperature, and the step of taking up the amorphous alloy wire 11 around the winder 6.

Each thin amorphous alloy wire 11 thus produced was of a diameter of about 8 μm and had a beautiful surface and a uniform diameter with inaccuracies of ±0.1 μm along the length of the wire 11.

Each thin wire 11 was examined for its structure by an X-ray diffraction and measured for its tensile strength to provide the results given in Table II. In Table II, the various legends have the same meaning as those legends in Table I.

As apparent from Table II, it was ascertained that all the thin wires 11 were of an amorphous phase and had extremely excellent mechanical properties with a tensile strength of 980 MPa or more.

TABLE II

| Alloy Composition | Wire | | Thin Wire | | |
|---|---|---|---|---|---|
| (Atomic in the Subscripts) | Tg (°K.) | Tx (°K.) | Structure | Diameter (μm) | Strength (Mpa) |
| $Al_{85}Co_5Ce_{10}$ | 607 | 615 | Amo | 8 | 980 |
| $Al_{78}Cr_3Cu_7Ce_{12}$ | — | 605 | Amo | 8 | 1060 |
| $Al_{86}Ni_4Y10$ | 525 | 535 | Amo | 8 | 1205 |
| $Al_{75}Ni_8Si_2Mm_{15}$ | 639 | 654 | Amo | 8 | 1085 |

The foregoing examples of thin aluminum-based alloy foils and wires and the processes for making same are illustrative of the invention and are not intended to be exhaustive of the products or processes within the scope of this invention as defined by the following claims.

What is claimed is:

1. A process for producing a thin aluminum-based alloy foil or wire having excellent strength and resistance to corrosion, by using an amorphous wire or foil shaped starting material which has been made by a quenching and solidifying process and which has a composition represented by the general formula:

$$Al_aM_bX_c$$

wherein:

M is one or more elements selected from a group consisting of V, Cr, Mn, Fe, Co, Ni, Cu, Zr, Ti, Mo, W, Ca, Li, Mg and Si;

X is one or more elements selected from a group consisting of Y, Nb, Hf, Ta, La, Ce, Sm, Nd and Mm (misch metal); and a, b, and c are atomic percentages falling within the following ranges:

$$50 \leqq a \leqq 95$$

$$0.5 \leqq b \leqq 35 \text{ and}$$

$$0.5 \leqq c \leqq 25,$$

the process for producing the thin aluminum-based alloy foil or wire comprising the steps of:

heating said amorphous material to a working temperature which falls within a glass transition region, a supercooled liquid region or ±30° K. of the crystallization temperature that is peculiar to the amorphous material;

subjecting the heated amorphous material to rolling or drawing under a tensile stress; and cooling the material to approximately room temperature; and wherein all the process steps are performed within a 600 sec. time period, and the rolling or drawing is conducted so as to obtain a foil product of a uniform thickness with inaccuracies of ±0.1 μm or less both across the width and along the length or a wire product of a uniform diameter with inaccuracies of ±0.1 μm along the length of the wire.

2. The process of claim 1, wherein said time period is determined so as to maintain an amorphous phase in the resulting product of at least 50%.

3. The process of claim 1, wherein the rolling or drawing is conducted so as to obtain a product of a uniform thickness of 10 μm or less in the form of a foil or a uniform diameter of 50 μm or less in the form of a wire.

4. The process of claim 1, wherein the process steps are performed within a 150 sec. time period.

5. The process of claim 1, wherein the rolling or drawing is conducted at a temperature between the crystallization temperature and 30° K. less than the crystallization temperature.

6. The process of claim 1, wherein said heating step is performed immediately before the rolling or drawing and said cooling step is performed immediately after the rolling or drawing.

7. The process of claim 1, wherein said room temperature at the cooling step is a temperature which is equal to or less than the crystallization temperature minus 200° K. so that the amorphous phase of the starting material will not be phase-converted to a crystalline phase.

8. The process of claim 1, wherein the process is conducted under a low stress and a rolling reduction of 50% or more.

9. The process of claim 1, wherein said starting material is a foil-shaped amorphous material which has been obtained by a liquid quenching process and has a thickness of 15–100 μm and an amorphous phase of not less than 50%.

10. The process of claim 1, wherein said starting material is wire-shaped amorphous material which has been obtained by a liquid quenching process and has a diameter of 80–150 μm and an amorphous phase of not less than 50%.

11. The process of claim 1, wherein the rolling is carried out at a rate of 20 m/min or more.

12. The process of claim 1, wherein the drawing is carried out at a rate of 5 m/min or more.

13. A process for producing a thin aluminum-based alloy foil or wire having excellent strength and resistance to corrosion, by using an amorphous wire or foil shaped starting material which has been made by a quenching and solidifying process and which has a composition represented by the general formula:

$$Al_aM_bX_c$$

wherein:

M is one or more elements selected from a group consisting of V, Cr, Mn, Fe, Co, Ni, Cu, Zr, Ti, Mo, W, Ca, Li, Mg and Si;

X is one or more elements selected from a group consisting of Y, Nb, Hf, Ta, La, Ce, Sm, Nd and Mm (misch metal); and a, b, and c are atomic percentages falling within the following ranges:

$$50 \leqq a \leqq 95$$

$$0.5 \leqq b \leqq 35 \text{ and}$$

$0.5 \leqq c \leqq 25$, the process for producing the thin aluminum-based alloy foil or wire comprising the steps of:

heating said amorphous material to a working temperature which falls within a glass transition region, a supercooled liquid region or ±30° K. of the crystallization temperature that is peculiar to the amorphous material;

subjecting the heated amorphous material to rolling or drawing under a tensile stress; and cooling the material to approximately room temperature; and wherein all the process steps are performed within a time period required to maintain an amorphous phase of the resulting product to be at least 50%, and rolling or drawing is conducted so as to obtain a foil product of a uniform thickness with inaccuracies of ±0.1 μm or less both across the width and along the length or a wire product of a uniform diameter with inaccuracies of ±0.1 μm along the length of the wire.

14. The process of claim 13, wherein the rolling or drawing is conducted so as to obtain a product of a uniform thickness of 10 μm or less in the form of a foil or a uniform diameter of 50 μm or less in the form of a wire.

15. The process of claim 13, wherein the process steps are performed within a 600 sec. time period.

16. The process of claim 13, wherein the process steps are performed within a 150 sec. time period.

17. The process of claim 13, wherein said heating step is performed immediately before the rolling or drawing and said cooling step is performed immediately after the rolling or drawing.

18. The process of claim 13, wherein the process is conducted under a low stress and a rolling reduction of 50% or more.

19. The process of claim 13, wherein said starting material is a foil-shaped amorphous material which has been obtained by a liquid quenching process and has a thickness of 15–100 μm and an amorphous phase of not less than 50%.

20. The process of claim 13, wherein said starting material is a wire-shaped amorphous material which has been obtained by a liquid quenching process and has a diameter of 80–150 μm and an amorphous phase of not less than 50%.

21. The process of claim 13, wherein the rolling is carried out at a rate of 20 m/min or more.

22. The process of claim 13, wherein the drawing is carried out at a rate of 5 m/min or more.

* * * * *